United States Patent [19]

Dungan

[11] Patent Number: 4,589,699

[45] Date of Patent: May 20, 1986

[54] SIT-KNEEL CHAIR

[76] Inventor: David L. Dungan, 1220 Bradford La., Knoxville, Tenn. 37919

[21] Appl. No.: 614,744

[22] Filed: May 29, 1984

[51] Int. Cl.[4] ..... A47C 7/50; A47C 7/00

[52] U.S. Cl. ..... 297/423; 248/395; 297/313; 297/346; 297/432

[58] Field of Search ..... 297/27, 28, 313, 346, 297/357, 374, 423, 429, 431, 432; 108/1, 4, 6; 248/393, 395, 419, 420

[56] References Cited

U.S. PATENT DOCUMENTS

| | | | |
|---|---|---|---|
| D. 265,612 | 8/1982 | Gusrud et al. | 297/423 X |
| 2,375,696 | 5/1945 | Shick | 297/429 |
| 2,499,884 | 3/1950 | Singleton | 297/429 |
| 2,691,559 | 10/1954 | Harry | 108/4 |
| 3,669,493 | 6/1972 | Vowles | 297/429 |
| 4,122,954 | 10/1978 | Slater | 108/6 X |
| 4,392,685 | 7/1983 | Leonhart | 297/429 X |
| 4,425,863 | 1/1984 | Cutler | 297/423 X |

FOREIGN PATENT DOCUMENTS

| | | | |
|---|---|---|---|
| 1342661 | 9/1963 | France | 297/346 |
| 401718 | 11/1933 | United Kingdom | 297/374 |

*Primary Examiner*—William E. Lyddane
*Assistant Examiner*—Peter R. Brown
*Attorney, Agent, or Firm*—Pitts and Brittian

[57] ABSTRACT

A sit-kneel chair (10) for distributively supporting the posterior of a user, and the knee and/or lower leg portion of a user. The chair (10) comprises a seat (12) for supporting the posterior of the user, and the knee support (14) for supporting the knee or lower leg portions of the user. The chair (10) further comprising a frame (16) including a first support assembly (20) for pivotally supporting the seat (12) and a second support assembly (22) for pivotally supporting the knee support (14). Means are also provided for selectively altering the linear distance between the seat (12) and the knee support (14). In the preferred embodiment, such means comprise a connector arm (40) secured to the first support assembly (20) for slidably engaging the second support assembly (22).

5 Claims, 4 Drawing Figures

94
54
96
92
12
88
14
10
34
38
36
80
46
50
66
24
70
16
68
56
84
22
20
44
26
44
40
42
76
57
58

SIT-KNEEL CHAIR

TECHNICAL FIELD

This invention relates to a sit-kneel chair which provides support for both the posterior and knee and/or lower leg portion of a user. More specifically, the chair comprises a frame for pivotally supporting a seat on which the user sits, and for pivotally supporting a knee support which serves to support the knee and/or lower leg portion of the user.

BACKGROUND ART

Most conventional chairs or sitting devices dictate a posture whereby the weight of the person seated in the chair is supported almost entirely, if not entirely, by the seat portion of the chair and the spine of the user receives essentially the entire stress associated with maintaining such posture. Further, the conventional chair dictates a posture whereby the legs are at substantially a right angle to the upper body. This radical angle places stress on the hip joints and lower spine, and places the body in an unnatural and unbalanced position.

There have been attempts to design chairs which reduce the stress on the user's spine and hip joints by distributing the user's weight between a seat and a knee and/or lower leg support, thus placing the body in a more naturally balanced seated position. One such device is disclosed by U.S. Pat. No. 4,328,991, issued to Mengshoel, et al., on May 11, 1982. This patent discloses a sitting device comprising a seat and a supporting means for the knee or calf leg portion of the user, thus allowing the user's weight to be distributed between the seat and such support means. However, the distance between the seat and the knee support means is fixed, and no provision is made for the adjustment of the device to compensate for variations in the stature of the various users, or simply for adjusting the device for the preferences of various users. Similarly, the chair disclosed by U.S. Pat. No. 3,669,493, issued on June 13, 1972, to J. H. Vowles, discloses a chair with a knee support. Although this chair allows certain adjustments to be made to compensate for the stature of the user, and for changes of posture, the design of the chair will not allow the distance between the seat and the knee support to be altered without altering the angular attitude or tilt of the seat or the knee support, with the reverse being true as well.

Therefore, it is an object of the present invention to provide a sit-kneel chair which allows the weight of the user to be distributively supported by a seat and a knee support so as to relieve spinal stress.

Another object of the present invention is to provide a sit-kneel chair which allows a sitting posture whereby the bend at the hip of the user is greater than the ninety (90) degree angle associated with the conventional sitting position, thus reducing stress on the lower back.

Still another object of the present invention is to provide a sit-kneel chair which allows the pivotal position of both the seat and the knee support to be independently adjusted and which allows the distance between the seat and the knee support to be adjusted independent of such pivotal adjustment.

Yet another object of the present invention is to provide a sit-kneel chair which allows independent height adjustment of the seat and knee support.

A further object of the present invention is to provide a sit-kneel chair which is inexpensive to manufacture and maintain.

DISCLOSURE OF THE INVENTION

Other objects and advantages will be accomplished by the present invention which provides a sit-kneel chair for supporting a user in a more naturally balanced sitting posture. The sit-kneel chair of the present invention comprises a seat for supporting the posterior of the user, and a knee support for supporting the knee or lower leg portions of a user. The chair further comprises a frame, including a first support assembly for pivotally supporting the seat and a second support assembly for pivotally supporting the knee support. Means are also provided for selectively alternating the linear distance between the seat and the knee support to allow the sit-kneel chair to be adjusted in accordance with the stature of the user. In one preferred embodiment, such means comprises a connector arm secured to the first support assembly for slidably engaging the second support assembly such that the distance between the first support assembly and the second support assembly, and thus the seat and the knee support, can be selectively altered.

BRIEF DESCRIPTION OF THE DRAWINGS

The above-mentioned features of the invention will become more clearly understood from the following detailed description of the invention read together the drawings in which.

BEST MODE FOR CARRYING OUT THE INVENTION

Figure 1:
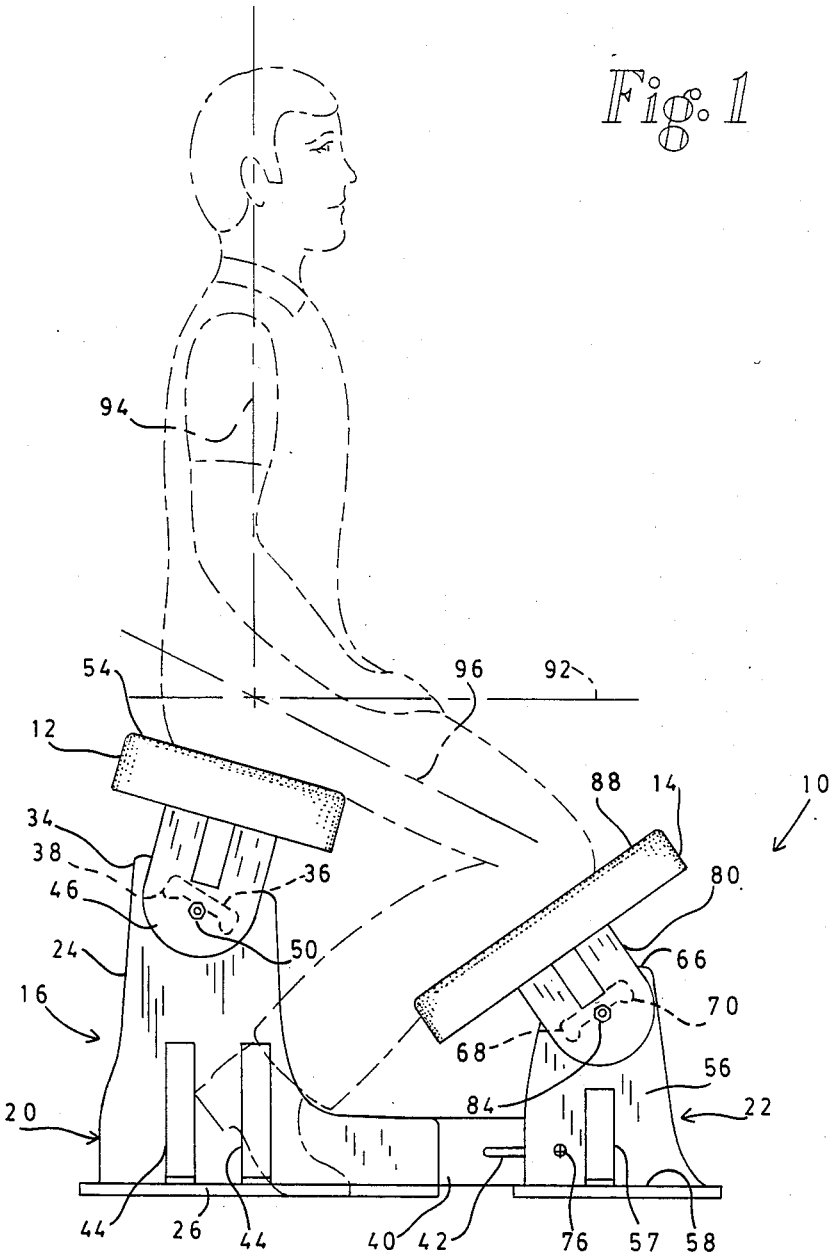
FIG. 1 illustrates a side elevation view of the sit-kneel chair of the present invention depicting a user seated in the chair.

A sit-kneel chair incorporating various features of the present invention is illustrated at 10 in the figures. The chair generally comprises a seat 12 and a knee support 14, both pivotally mounted on an adjustable support frame 16. As illustrated in FIG. 1, the chair 10 is designed such that the user is seated on the seat 12 with the user's knees or lower leg portions supported by the knee support 14. Thus, as will be discussed further below, the user is distributively supported by both the seat 12 and the knee support 14, rather than by the seat alone as is the case with most conventional chairs or sitting devices.

More specifically, the frame 16 includes a first support assembly 20 for pivotally supporting the seat 12 and a second support assembly 22 for pivotally supporting the knee support 14. The first support assembly 20 comprises an upwardly extending seat support member 24 supported on a base 26. In the illustrated embodiment of the figures, the seat support member 24 comprises a center support 28 to which a pair of oppositely disposed panels 30 and 32 are secured, with the panels 30 and 32 extending upwardly beyond the center support 28 such that the upper end portions of the seat support member 24 define a clevis 34 for pivotally engaging the seat 12.

Figure 2:
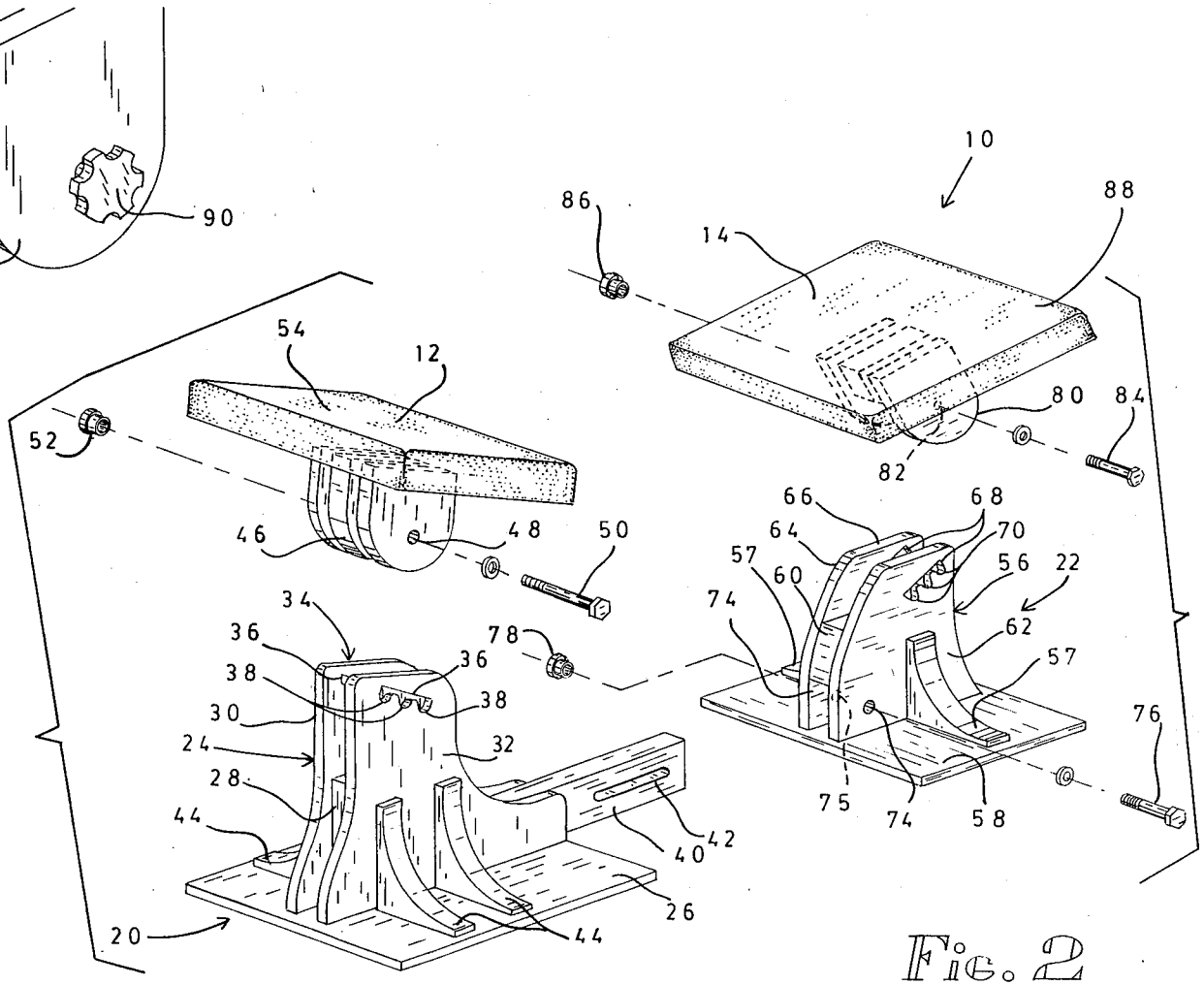
FIG. 2 illustrates an exploded perspective view of the sit-kneel chair of the present invention.

Of course, it will be appreciated that the support member 24 can be integrally formed with the clevis 34 defined at its upper end portion. Further, as illustrated in FIG. 2, the clevis 34 defines a pair of registering slots 36 provided with selectively spaced registering notches 38 which, as will be discussed in detail below, facilitate the selective pivotal positioning and height adjustment of the seat 12. Continuing with regard to the first support assembly 20, the assembly 20 further comprises a forwardly extending connector arm 40 provided with an elongated slot 42 therethrough, the connector arm 40 serving to adjustably engage the second support assembly 22. Further, in the preferred embodiment, the first support assembly 20 is provided with brace members 44 secured to both the seat support member 24 and the base 26 for bracing the seat support member 24 in its upright position on the base 26.

As indicated above, the seat 12 is pivotally mounted on the first support assembly 20. Accordingly, on its lower surface, the seat 12 is provided with a yoke member 46 defining registering coaxial holes 48 (see FIG. 4). The yoke member 46 is receptive of the clevis 34 of the seat support 24, the clevis 34 being pivotally secured in the yoke member 46 with a bolt 50. More specifically, the bolt 50 is received through the holes 48 of the yoke member 46 and the slots 36 of the clevis 34 and threadably secured with a suitable locking nut 52. It will be noted that the slots 36 of the clevis 34 are angled such that the relative heights of the notches 38 disposed along the slots 36 increase with the upward incline of the slots 36. Thus, by selectively positioning the bolt 50 in the desired registering notches 38, the height of the seat 12 can be adjusted. Further, through the selective tightening of the bolt 50, the seat 12 can be adjusted where the seat 12 pivots in response to a preselected manipulative force or can be secured in a desired pivotal position so as to require loosening of the bolt 50 prior to pivoting. It will be appreciated that this ability to preselectively adjust the force necessary for pivoting the seat 12 allows the user to adjust the seat 12 such that it holds its pivotal position while supporting the user, yet is pivotally responsive to force exerted on the seat 12 as a result of deliberate posture changes by the user.

Of course, for the comfort of the user, the seat 12 can be provided with a cushioned upper surface 54 as in the illustrated embodiment. However, it is contemplated that the cushioned surface 54 is optional and, as with conventional chairs, a rigid seat surface is acceptable for some uses.

The second support assembly 22 comprises an upwardly extending further support member 56, supported on and extending upwardly from a base 58. In the illustrated embodiment, the further support member 56 comprises a center support 60 to which a pair of oppositely disposed panels 62 and 64 are secured with the panels 62 and 64 extending upwardly beyond the center support 60 such that the upper end portions of the panels 62 and 64 define a clevis 66. However, as is the case with the seat support member 24, the further support member 56 can be integrally formed with a suitable clevis defined at its upper end portion. The clevis 56 defines a pair of registering slots 68 provided with selectively spaced registering notches 70. Additionally, brace members 57 can be provided to further support the further support member 56 in its upright position.

The further support member 56 is also provided with a receptor slot 72 closely and slidably receptive of the connector arm 40 of the first support assembly 20. Further, the panels 62 and 64 are provided with oppositely disposed registering holes 74 and 75, respectively, which register with the elongated slot 42 as the connector arm 40 is received in the receptor slot 72. In order to slidably secure the connector arm 40 within the receptor slot 72, the bolt 76 is received through hole 74, the elongated slot 42, and the hole 75, and secured with a suitable locking nut 78. Thusly secured, it will be appreciated that the distance between the seat 12 and the knee support 14 can be adjusted by the selective positioning of the connector arm 40 within the receptor slot 72. Further, the connector arm 40 can be releasably secured in the desired position by tightening the bolt 76 which forces the adjacent portions of the panels 62 and 64 to press inwardly to releasably engage the closely received connector arm 40 and secure it in position.

Figure 4:
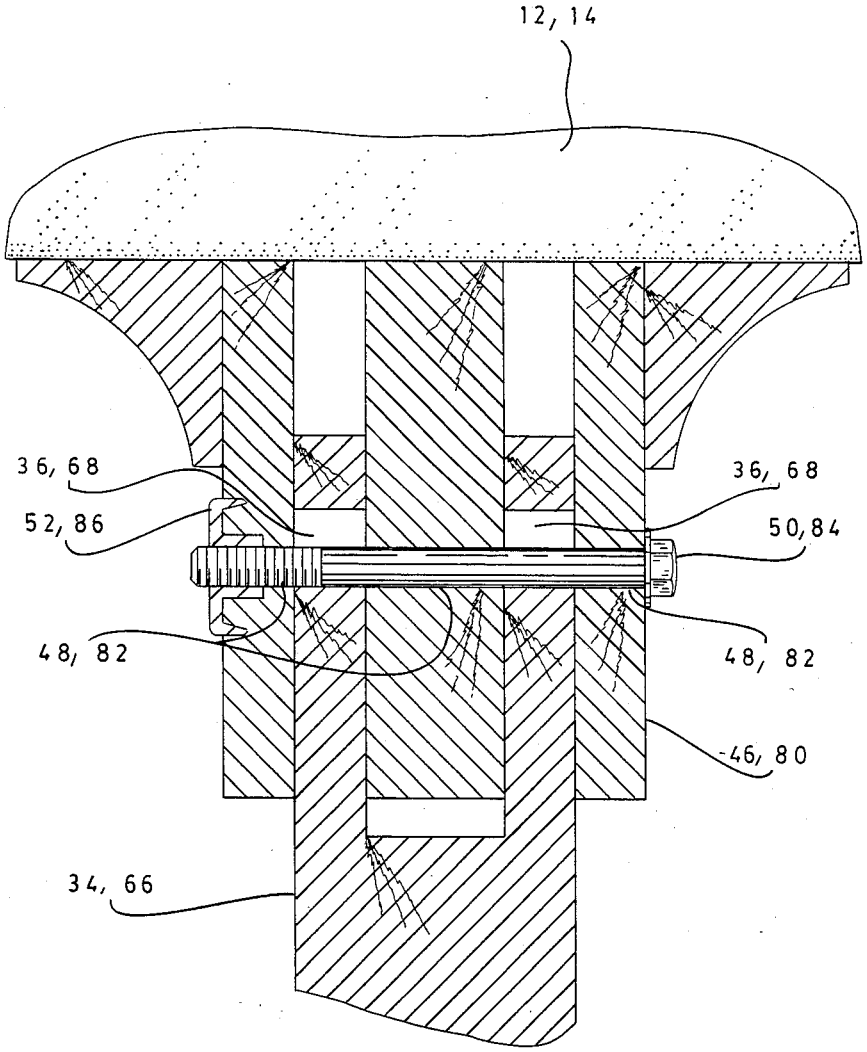
FIG. 4 illustrates an end view, in section, of a yoke and clevis of the chair of the present invention.

In order to pivotally secure the knee support on the second support assembly 22, the knee support 14 is provided with a yoke member 80 defining registering coaxial holes 82 (see FIG. 4). The yoke member 80 is receptive of the clevis 66 of the further support assembly 22, the clevis 34 being pivotally secured in the yoke member 46 with a bolt 84 which is received through the holes 82 and the slots 68 and threadably secured with a suitable locking nut 86. Thusly secured, the knee support 14 can be pivotally adjusted as discussed above with regard to the pivotal adjustment of the seat 12. Of course, as with the seat 12, the knee support 14 can be provided with a cushioned upper surface 88 as illustrated in the preferred embodiment of the figures.

Figure 3:
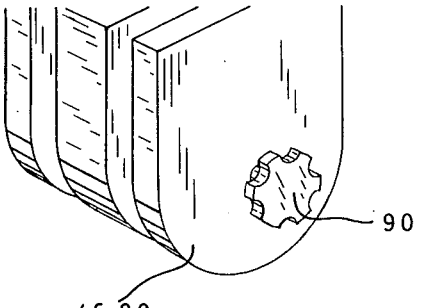
FIG. 3 illustrates a perspective view of a yoke member and handle for adjusting the pivotal position of the seat or knee support of the present invention.

Referring now to FIG. 3, in an alternative embodiment of the chair 10, the bolts 50, 76 and 84 are provided with handles such as the handle 90 for rotating the bolts 50, 76 and 84. The handle 90 thus obviates the need for wrenches or other tools to adjust the chair 10.

Thus, it will be appreciated that the present invention provides a sit-kneel chair which distributively supports the weight of a user between the seat 12 and the knee support 14, thus reducing stress on the spine of a user. Additionally, the chair 10 allows a more natural sitting posture whereby the angle defined by the spine and upper leg portions of the user is greater than the ninety (90) degree angle associated with the conventional sitting posture. As illustrated in FIG. 1, for example, when seated in a conventional sitting posture, a user's legs, the alignment of which is illustrated by phantom line 92, are essentially at a right angle to the spine, the alignment of which is illustrated by the phantom line 94. However, in the sit-kneel chair 10 of the present invention, the legs of the user, the alignment of which is illustrated by phantom line 96, form an angle greater than ninety (90) degrees, thus defining a less radical bend at the hip. Accordingly, stress on the lower back and hips is reduced and lower back pain is avoided. Further, the chair 10 provides for the independent adjustment of the pivotal position of the seat and knee support, and also allows for the distance between the seat and the knee support to be selectively altered. Provision is also made for independently raising and lowering the seat member and the knee support as desired.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A sit-kneel chair for supporting a person, said chair being adjustable to accommodate a specific stature of said person, which comprises:

a seat for supporting the posterior of said person, said seat having an under surface;

a knee support for supporting the forward portion of the knee or lower leg portion of said person, said knee support having an under surface;

a frame having a. a first support asssembly for said for said seat, said first support assembly having a first base and an upstanding seat support member having an upper end, b. a second support assembly for said knee support, said second support assembly having a second base and an upstanding knee support member, and c. a connector means between said first and second bases, said connector means providing for adjustment of spacing between said first and second bases and thus between said seat and said knee support;

a first adjustment assembly for selecting tilt and height of said seat with respect to said upper end of said seat support member, and spacing of said seat from knee support, said first adjustment assembly comprising a. a yoke member having parallel brackets attached to said under surface of said seat, said brackets provided with aligned apertures, b. a clevis member at said upper end of said seat support member having parallel brackets to intermesh with said brackets of said yoke, said brackets of said clevis each provided with an inclined slot with a first end toward said knee support being closer to said first base than a second end, said slots provided with a plurality of selectivity spaced notches in a lower edge, and c. a first fastener member passing through said slots of said clevis and said apertures in said yoke member, said fastener member provided with means for clamping said yoke member to said clevis member when said seat is properly positioned for tilt, height and spacing for said person; and a second adjustment assembly for selecting tilt and height of said knee support with respect to said upper end of said knee support member, and spacing of said knee support from said seat, said second adjustment assembly comprising a. a yoke member having parallel brackets attached to said under surface of said knee support, said brackets provided with aligned apertures, b. a clevis member at said upper end of said knee support member having parallel brackets to intermesh with said brackets of said yoke, said brackets of said clevis each provided with an inclined slot with a first end toward said knee support being closer to said second base than a second end, said slots provided with a purality of selectively spaced notches in a lower edge, and c. a second fastener member passing through said slots of said clevis and said apertures in said yoke member of said second adjustment assembly, said second fastener member provided with means for clamping said yoke member to said clevis member when said knee support is properly positioned for tilt, height and spacing for said person.

2. The sit-kneel chair of claim 1 wherein said seat support member comprises: a vertically-oriented first center support having a first end proximate said first base; and a first pair pf oppositely disposed panels sandwiched with said first center support, said panels attached at a first end to said first base, and forming said clevis of said first adjustment assembly at a second end.

3. The sit-keel chair of claim 1 wherein said knee support member comprises: a vertically-oriented second center support having a first end proximate said second base; and a second pair of oppositely disposed panels sandwiched with said second center support, said panels attached at a first end to said second base, and forming said clevis of said second adjustment assembly at a second end.

4. The sit-kneel chair of claim 2 wherein said connector means includes a receptor channel provided on said knee support member proximate with said second base and with aligned apertures intersecting with said receptor channel, and with an adjustment fastener passing through said apertures, and wherein said seat support member further comprises a connector bar proximate said first base projecting toward and receptive in said receptor channel in said second support assembly, said connector bar being provided with a longitudinal slot to accept said adjustment fastener whereby spacing between said first and second bases can be adjusted for comfort of said person.

5. A sit-kneel chair for supporting a person, said chair being adjustable to comfortably accommodate a specific stature of said person when using said chair, which comprises:

a seat for supporting the posterior of said person, said seat having an under surface, with a seat yoke yoke member having parallel brackets attached to said under surface of said seat, said brackets provided with aligned apertures;

a knee rest for supporting the forward position of the knee or lower leg portion of said person, said knee rest having an under surface, with a knee rest yoke member having parallel brackets attached to said under surface of said knee rest, said brackets provided with aligned apertures;

a seat support assembly having a first base, a vertically oriented first center support with a first end proximate said first base and a second end, and a first pair of oppositely disposed panels sandwiched with said first center support, said panels attached at a first end to said first base, and forming a seat clevis at a second end for meshing with said seat yoke member, said panels at said seat clevis each provided with an inclined slot with a first end toward said knee rest being closer to said first base than a second end, said slots provided with a plurality of spaced apart notches in a lower edge;

a knee rest support assembly having a second base, a vertically oriented second center support with a first end proximate said second base and a second end, and a second pair of oppositely disposed panels sandwiched with said second center support, said panels attached at a first end to said second base, and forming a knee rest clevis at a second end for meshing with said knee rest yoke member, said panels at said knee rest clevis each provided with an inclined slot with a first end toward said seat being closer to said second base than a second end, said slots provided with a plurality of spaced apart notches in a lower edge, said knee rest support assembly provided with a receptor channel proximate said second base and with aligned apertures intersecting with said receptor channel;

a connector bar having a first end attached proximate said first base of said seat support assembly between said first pair of panels, with a second end for being received in said receptor channel in said knee rest support assembly, said second end provided with a longitudinal slot to be aligned with said apertures intersecting said receptor channel;

a first fastener member passing through said slots of said seat clevis of said seat support assembly and said apertures of said seat yoke member whereby said seat clevis and said seat yoke member can be clamped together when said seat is properly positioned for tilt, height, and spacing for said person;

a second fastener member passing through said slots of said knee rest clevis of said knee rest support assembly and said apertures of said knee rest yoke member whereby said knee rest clevis and said knee rest yoke member can be clamped together when said seat is properly positioned for tilt, height and spacing for said person; and a third fastener member passing through said apertures in said knee rest support assembly intersecting said receptor channel and through said slot in said connector bar whereby said connector bar can be clamped in said receptor channel when said seat support assembly and said knee rest support assembly are properly positioned for spacing for said person.

* * * * *